US006544106B1

(12) United States Patent
McHugh et al.

(10) Patent No.: US 6,544,106 B1
(45) Date of Patent: Apr. 8, 2003

(54) DRESSING OF GRINDING WHEELS

(75) Inventors: Donald McHugh, Romulus, MI (US); Jay Merkle, Williamston, MI (US)

(73) Assignee: Unicorn Abrasives Limited, Stafford (GB)

( * ) Notice: Subject to any disclaimer, the term of this patent is extended or adjusted under 35 U.S.C. 154(b) by 0 days.

(21) Appl. No.: 09/744,760

(22) PCT Filed: Aug. 10, 1998

(86) PCT No.: PCT/GB98/02402

§ 371 (c)(1),
(2), (4) Date: Apr. 26, 2001

(87) PCT Pub. No.: WO00/09291

PCT Pub. Date: Feb. 24, 2000

(51) Int. Cl.[7] ..... B24B 49/00
(52) U.S. Cl. ..... 451/21; 451/11
(58) Field of Search ..... 451/56, 44, 443, 451/21, 11, 10; 125/11.01

(56) References Cited

U.S. PATENT DOCUMENTS

| | | | | |
|---|---|---|---|---|
| 2,772,670 A | | 12/1956 | Jones, Jr. | |
| 3,667,445 A | | 6/1972 | Ota | |
| 3,822,689 A | | 7/1974 | Oshima | |
| 4,073,281 A | | 2/1978 | Asaeda et al. | |
| 4,278,448 A | * | 7/1981 | Ishizuka et al. | 51/295 |
| 4,374,513 A | | 2/1983 | Wiener | |
| 4,953,522 A | * | 9/1990 | Vetter | 125/11.01 |
| 5,647,788 A | | 7/1997 | McHugh et al. | |
| 6,102,789 A | * | 8/2000 | Ramanath et al. | 451/541 |

FOREIGN PATENT DOCUMENTS

| | | |
|---|---|---|
| DE | 2453446 | 5/1976 |

* cited by examiner

*Primary Examiner*—Dung Van Nguyen
(74) *Attorney, Agent, or Firm*—Caesar, Rivise, Bernstein, Cohen & Pokotilow, Ltd.

(57) ABSTRACT

A method of dressing a grinding wheel by advancing a dressing tool across the surfaces to be dressed, the method comprising first moving the dressing tool across each side portion to remove material to make the wheel of predetermined width and then across the edge of the wheel to form corner radii, wherein the dressing tool is rotated as it is advanced and the speed of advancement across the side surfaces is different from that across the edge.

17 Claims, 4 Drawing Sheets

DRESSING OF GRINDING WHEELS

FIELD OF THE INVENTION

The invention relates to the dressing of grinding wheels, and in particular to the dressing of the side portions and edge faces of grinding wheels.

BACKGROUND OF THE INVENTION

It is necessary to dress the side portions of grinding wheels used to grind crankshafts and like articles. This is a particularly demanding job, because of the fine tolerances and complex shapes, e.g. curved surfaces, re-entrants and the like. The present industrial method is to side dress the grinding wheel using a single point diamond, working from the table of the grinding machine. This process is very time consuming as the operator has to mount a fixture on the table, and then move the table to start dressing the wheel. The operator normally dresses one side of the wheel, and then stops to make a measurement for the amount that will be required to be removed from the other side portion of the wheel. Once the operator starts to dress the other side portion, he has to stop when he feels that he may be near the intended size (to make sure that the wheel will not be undersized). The process will take from 4 to 8 hours, dependant on the machine and the type of controls which are available. If the operator .does not exercise enough care and patience, he will damage the surface of the wheel, e.g. cause so-called burn of the part, which could mean scrapping the wheel, or make the width of the wheel undersize and out of tolerance.

It is one object of the invention to provide a method and apparatus for use in dressing a grinding wheel, which requires less time, provides a wheel of high accuracy with little or no risk of damage.

SUMMARY OF THE INVENTION

According to the invention in one aspect there is provided a method of dressing a grinding wheel by advancing a dressing tool across the surfaces to be dressed, the method comprising first moving the dressing tool across each side portion to remove material to make the wheel of predetermined width and then across the edge of the wheel to form corner radii, wherein the dressing tool is rotated as it is advanced and the speed of advancement across the side surfaces is different from that across the edge portion.

Preferably the dressing tool is caused to travel in successive paths across each side portion, each path starting remote from the circumference of the wheel and finishing adjacent that circumference.

Preferably the method includes the step of moving the tool away from the wheel once it is reached the circumference and then back to the start position for the next path, whereby the tool dresses the wheel in one direction only.

It is a preferred feature of the invention that the speed of movement across a side portion exceeds that across the edge portion.

It is a further preferred feature that the method includes the step of supplying coolant liquid to the dressing tool to pass between the tool and the surface to be dressed.

Preferably the dressing tool is mounted in a holder supporting a power source for rotation of the tool and the coolant liquid is sprayed in a direction so as to cool also the power source.

Preferably the dressing tool is rotated at a speed of about 1000 to 3500 rpm when dressing the side surface. Preferably the rate of rotation is about 1800 rpm when dressing the side surface and about 2200 rpm when dressing the edge portion.

It is a preferred feature that the dressing tool has particles of diamond or like material for the dressing action which particles have a mean particle size selected to avoid burn or glaze of the grinding wheel surface. Preferably the particle size is about 16 to 28 mesh (US sieve size), most preferably 18 to 20. Preferably the particles are present in a density of about 1.8 to about 3 carats per square inch, most preferably about 2.9 carats/sq.in.

Because of the method of the invention the rotary tool may be bigger than usual, i.e. the rotary tool has a diameter of about 100 mm (3.937 inch)

It is a much preferred feature of the invention that the step of controlling the rate of rotation and the speed of travel of the dressing tool by microprocessor control means.

In a variation the method includes the step of shaping the edge portion in addition to forming the radii, say introducing curvature to the edge portion.

In another aspect the invention includes a rotary tool comprising a frame holding at its upper end a servomotor from which depends a spindle, a rotary dressing tool mounted at the free end of the spindle, the tool having particles of diamond or like material for the dressing action which particles have a mean particle size selected to avoid bum.

BRIEF DESCRIPTION OF THE DRAWINGS

In order that the invention may be well understood it will now be described by way of example with reference to the accompanying diagrammatic drawings, in which.

DETAILED DESCRIPTION OF THE INVENTION

The apparatus and method of the invention is adapted to provide a grinding wheel G of predetermined shape and dimensions. In particular the rim portion of the wheel G is to be of a predetermined width W with parallel side portions S1,S2 and corner radii R1,R2. In essence the apparatus includes a dressing tool R adapted to dress each of the side portions S1,S2 in succession and then the edge corners.

Figure 1A:
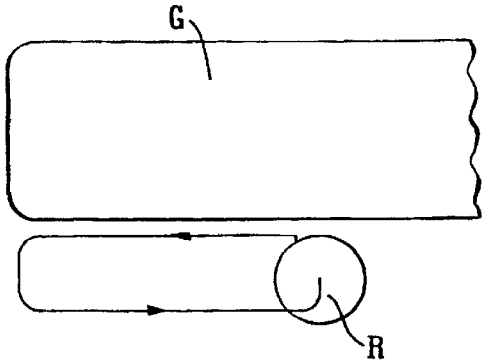
FIG. 1A is a schematic diagram showing a grinding wheel and the path travelled by a tool before dressing.
Figure 1B:
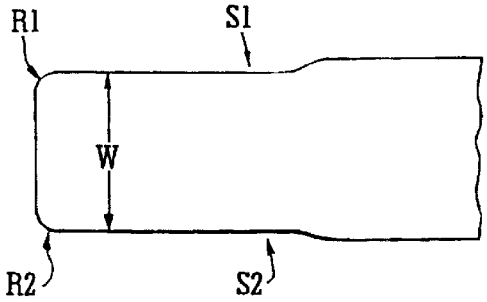
FIG. 1B is an edge view showing the wheel after dressing.

FIGS. 1A and 1B illustrate the basic principle of the mode of operation of the apparatus, (the detail of which will be described later). A dressing tool R is moved towards the required innermost point on the side portion while spaced slightly away from the wheel G. The tool is then contacted with one side of the wheel G to dress that surface. When the tool reaches the perimeter of the wheel G it is moved away and returned to the start point and the dressing repeated, i.e. dressing takes place in one direction only, as is illustrated by the arrows of the flow path. This dressing is performed on one side (S1 as shown in FIG. 1A) and the process is repeated on the other side (S2) until the dressing portion of the wheel G has attained the width W. The dressing tool R is then moved across the perimeter to form the corner radii R1,R2.

Figure 4:
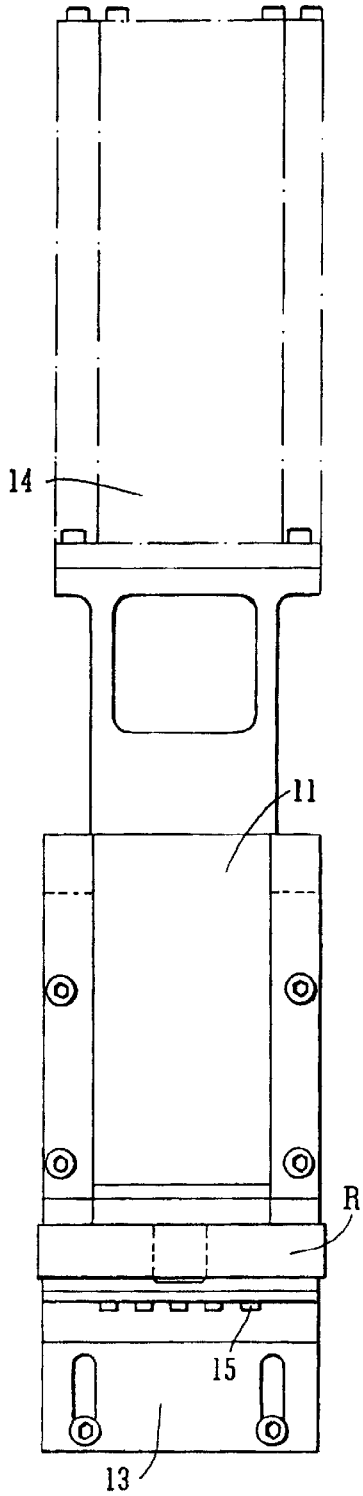
FIG. 4 is a front elevation of the rotary tool of FIG. 2.
Figure 2:
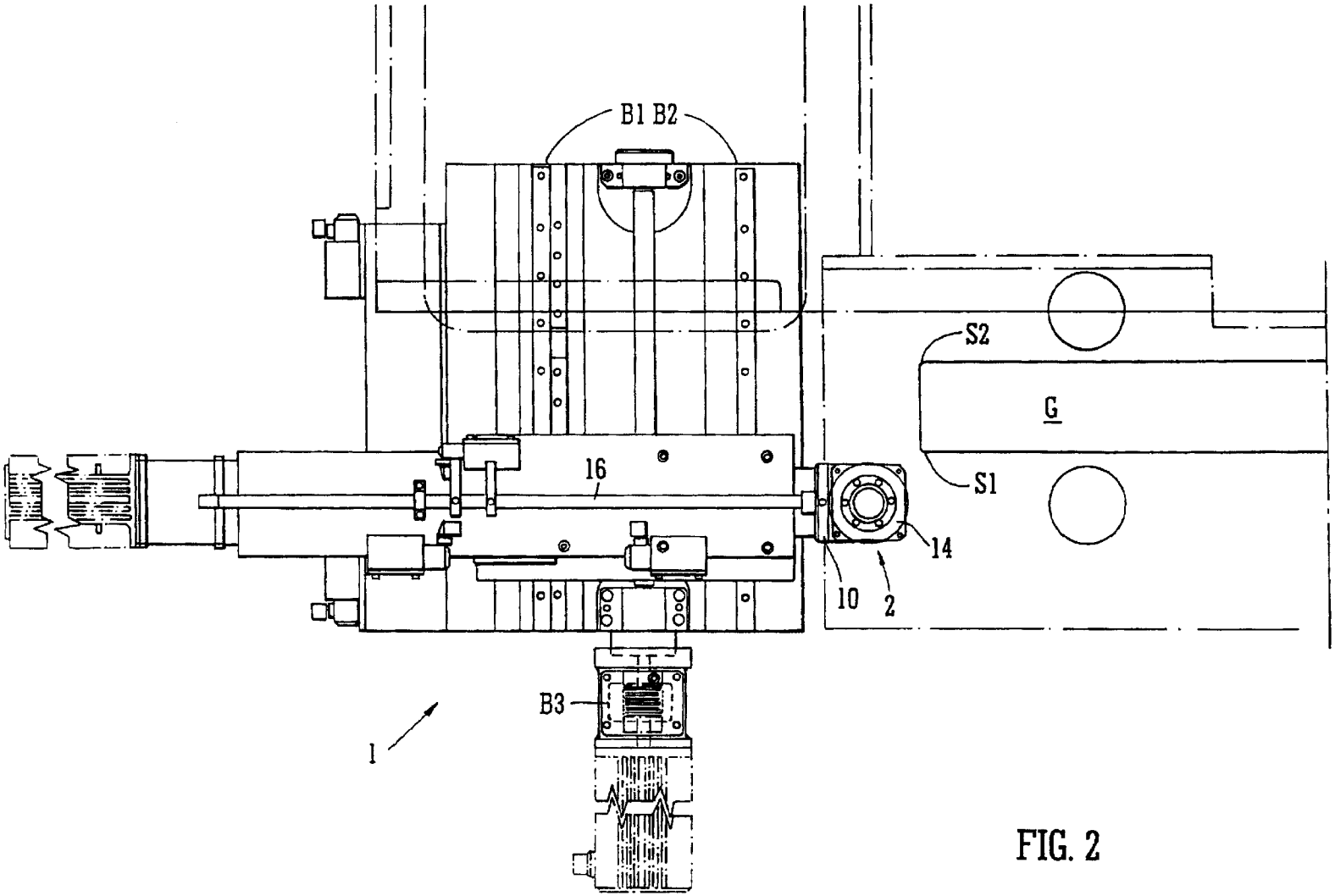
FIG. 2 is a top plan of one apparatus of the invention.
Figure 3:
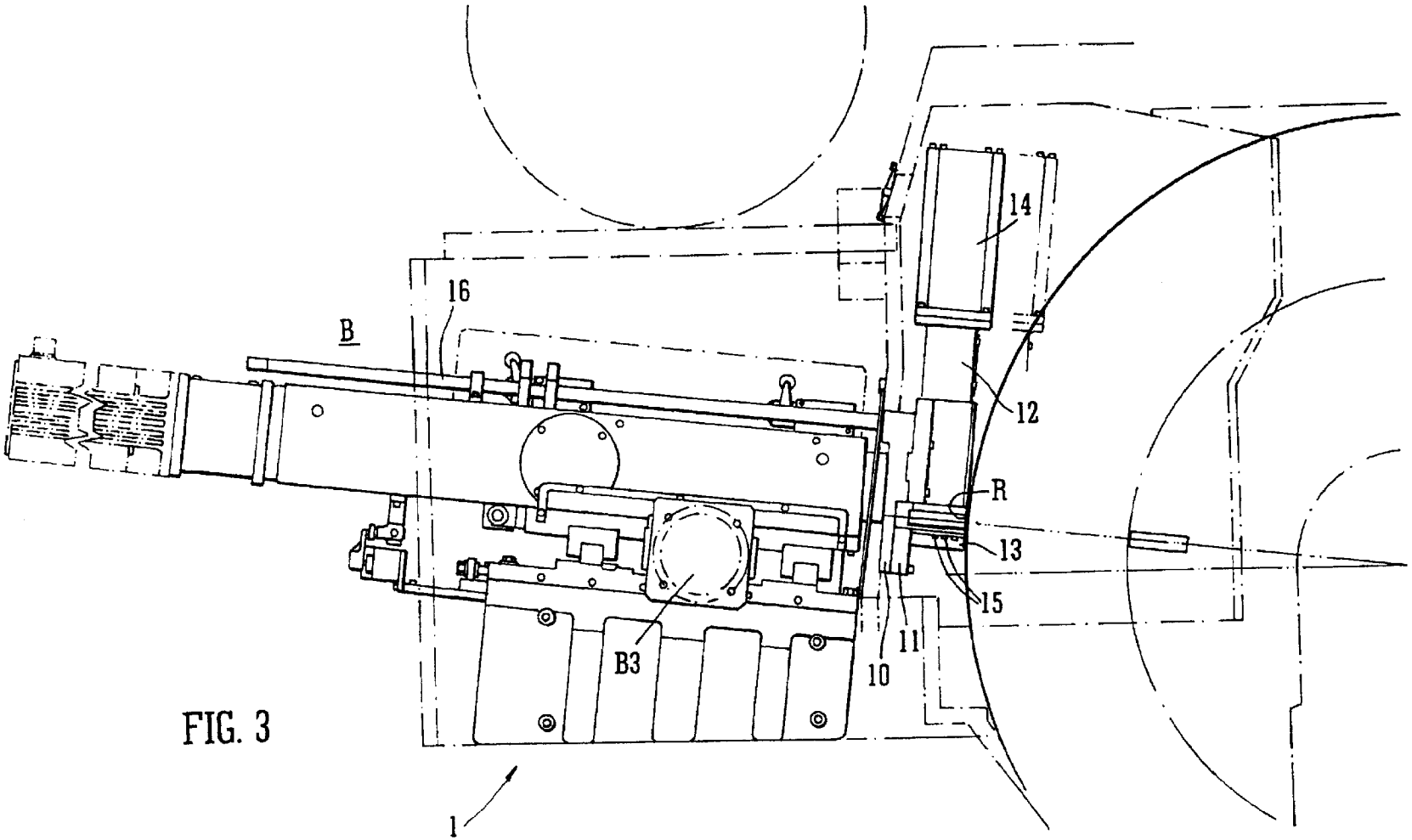
FIG. 3 is a side elevation of the apparatus of FIG. 2.

The apparatus shown in FIGS. 2 to 4 comprises a carriage assembly 1 carrying at its front end a rotary head assembly 2. The carriage assembly is arranged to move the head assembly both towards and away from the wheel G and across the width to dress both side portions, as indicated.

The rotary head assembly 2 comprises a rear support wall 10 having a front block 11 on top of which is a spindle assembly 12. A floor 13 projects forward from the lower end of the rear wall 10, above which is a diamond roll tool R mounted on the spindle 12. The roll R consists of a disc having a dressing face made up of natural particles (e.g. CBN) secured, e.g. by resin or metal bond, infiltrate or electroplate, to the surface of the roll. The diameter of the disc is about 100 mm. The particles have a mean diameter of not less than 18 to 20 mesh sieve size and are present in a density of about 2.9 carats/sq. in.

A servomotor 14 is mounted above the spindle 12. This may be a MOOG 304A 13XA servomotor, and is arranged to rotate the spindle 12 in turn to rotate the roll tool T at speeds ranging from as low as 1000 rpm to as high as 3500 rpm.

Outlets 15 are present in the floor 13 to spray coolant liquid on to the roll R and the workpiece G being treated, and up on to the spindle assembly 12,14 to cool that too. The coolant reaches the outlets via the pipe 16.

The carriage assembly for moving the rotary head assembly is similar to that described and claimed in our U.S. Pat. No. 5,647,788 issued on Jul. 15, 1997. The disclosure of that document is enclosed herewith merely by this reference. The assembly contains ball assemblies B1,B2,B3 arranged at right angles so that the assembly may be moved towards and away from the wheel and across its thickness. (The ball assemblies are shown shielded in bellows). Each is driven by a servomotor not shown. The number of ball screw assemblies will be chosen according to need; in this embodiment there are five.

The carriage assemblies are arranged so that the roll assembly may move about 26 cm (10.8 inch) towards and away from the wheel G, which may range from about 71 cm (28 inch) centre to about 1668 cm (42 inch) centre in diameter and up to about 13 cm (5 inch) in diameter.

The apparatus is arranged to be moved under computer control. The program is arranged to provide the following parameters in which IN means inches; IPM means inch per minute; RPM means revolutions per minute; SFPM means square feet per minute;

| | |
|---|---|
| Rough pass amount: | .00001–.00500 IN |
| Finish pass amount: | .00001–.00500 IN |
| Continuous dress passes: | 1–99 |
| Min. diameter of wheel: | 28.0–42.0 IN |
| Rough traverse speed: | .0001–30.0000 IPM |
| Finish traverse speed: | .0001–20.0000 IPM |
| Radius speed: | .001–30.0000 IPM |
| Width of wheel: | 2.0000–2.5000 IN |
| Left radius of wheel: | .0100–5.0000 IN |
| Right radius of wheel: | .0100–5.0000 IN |
| Diamond roll radius: | 1.2500–2.2000 IN |
| Taper adjust: | +.01000– –.01000 IN W-Axis |
| Offset: | +.0100– –.01000 IN |
| Diamond roll RPM | 1000–3500 RPM |
| Wheel SFPM: | 6800–7800 SFPM |
| Concave amount: | +.01000– –.01000 IN |
| New wheel width: | 2.0000–2.5000 IN |

Figure 5:
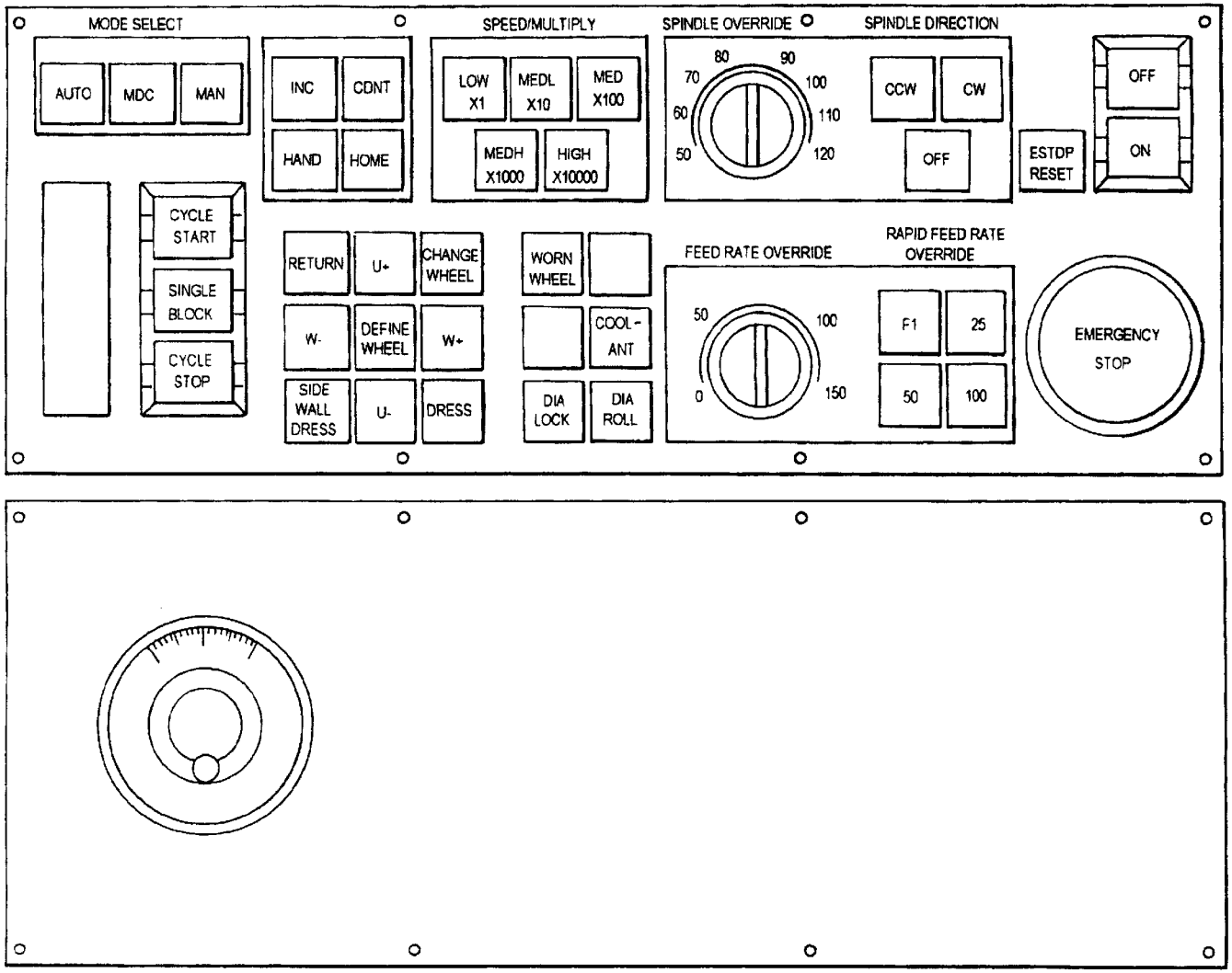
FIG. 5 shows the control panel

The operator then sets up the apparatus using the controls on the panel shown in FIG. 5 using controls as follows:

The POWER UP procedure is as follows:

1. At the dresser station, depress the "ON" pushbutton
2. Release the "EMERGENCY STOP" red pushbutton
3. Depress the "E-STOP RESET" pushbutton
4. Depress the "MAN" (Manual) pushbutton
5. Press "RETURN"
6. Depress the "HOME" pushbutton
7. Depress the "U+" pushbutton
8. The dresser should now be going through the homing process
9. Proceed to the color CRT for the following:
   a. Depress the "TRANSMIT" pushbutton
   b. Depress the "PROC SELECT" pushbutton
   c. The dresser should be homed Dresser Pushbuttons 1. With the "CONT" (Continuous) button depressed, the speed multiply rates can be selected
2. With the "INC" (Incremental) button depressed, the incremental distance of the "U" or "W" axis would be selected from: (defined below)
   LOW
   MEDL
   MED
   MEDH
   HIGH
3. With the "HAND" (Handwheel) button depressed, the hand wheel distance per detent (click) would be selected
   LOW
   MEDL
   MED
   MEDH
   HIGH With the "HAND" selected, choose the axis to move by depressing either "U+"/"U–" or "W+"/"W–". The "U" axis is the infeed axis with the "U–" going in toward the wheel and the "U+" retracting away from the grinding wheel. The "W" axis is the dresser traverse axis with the "W–" going in toward the inside of the grinding wheel. (Away from the operator if positioned at the dressing station) and the "W+" traverses the dresser toward the outside of the grinding wheel (toward the operator if positioned at the dresser).

He then pushes a "RETURN" pushbutton to causes the axis to return to the starting point for preparation of a dress. This pushbutton will only return to a start of dress position, if the axes have been defined relative to the grinding wheel. The "RETURN" pushbutton light will be on when the dresser is in the dresser returned position.

"SIDEWALL DRESS" Depressing this pushbutton causes the dresser to do a side dress of the wheel. This button is only active after a "CHANGE WHEEL" cycle has taken place. The "SIDEWALL DRESS" pushbutton light will be on during a sidedress cycle.

"DEFINE WHEEL" Depressing this pushbutton causes the control to have the starting points defined for a sidedress or a regular dress. The "W axis" must always be defined before the "U axis". This pushbutton is only active in "HAND" mode and with either "U" or "W" selected. The "DEFINE WHEEL" light will be on after the wheel has been properly defined.

"CHANGE WHEEL" Depressing this pushbutton causes the control to reset the wheel size and the dress start positions. The axes will move back to the home positions and the "RETURN" light as well as the "DEFINE WHEEL" light will go off. The new grinding wheel will now need to be defined. This pushbutton sets up the conditions to use the "SIDEWALL DRESS". During a change wheel cycle, this pushbutton light will be on.

"DRESS" Depressing this button causes an automatic dress as defined by the dress edit parameters that are programmed at the color CRT. During a dress, this pushbutton light will be on.

"WORN WHEEL" This is a light only and indicates a worn wheel condition.

"DIA LOCK" Depressing this pushbutton locks the diamond roll for setup purposes only. To lock the diamond roll during a return pass of the dresser the unit must be programmed at the color CRT. The "DIA LOCK" light indicates the locked status of the diamond roll.

"COOLANT" Depressing this pushbutton turns on the diamond roll coolant. The pushbutton light indicates when the coolant is on.

"DIA ROLL" Depressing this pushbutton causes the diamond roll to turn on at the programmed speed. The pushbutton light indicates when the diamond roll is on.

"FEEDRATE OVERRIDE" This rotary switch overrides the feedrate of the axis from 0–150%. Rotating this switch to a "0" will cause the axis to stop moving.

"EMERGENCY STOP" This latched pushbutton when depressed, turns off the diamond roll motor, diamond coolant, U axis and W axis. Rotating this pushbutton clockwise will release it.

"EMERGENCY RETURN" Depressing this yellow mushroom head pushbutton will abort a dress cycle, retract the U axis, turn off the diamond roll and turn off the dresser coolant.

"SPINDLE CCW" Depressing this button turns the grinding wheel on.

"SPINDLE OFF" Depressing this button turn the grinding wheel off provided that the "SPINDLE CCW" button was on while the grinding wheel was running.

Setup For Dressing or Sidewall Dress;

1. Axes must be homed.
2. If preparing for a sidewall dress, press "CHANGE WHEEL".
3. Advance the "U" axis centerline of the diamond roll beyond the small radius of the side of the grinding wheel.
4. Select "HAND".
5. Select appropriate "SPEED/MULTIPLY" pushbuttons.
6. Select "W+/W−".
7. Both "W+" and "U−" lights should now be on.
8. Rotate the handwheel clockwise.
9. As the side of the wheel is approached, change the "SPEED/MULTIPLY" switch to a finer selection and eventually ending up with the "LOW" selected as the side of the wheel is just touched by the diamond roll.
10. While still in hand and the "W" axis lights on, depress the "DEFINE WHEEL" pushbutton. The "W" axis lights should now go off.
11. Reposition the diamond roll now to be near the center of the outside diameter of the grinding wheel.
12. Select "HAND".
13. Select appropriate "SPEED/MULTIPLY" pushbutton.
14. Select "U+/U−".
15. Both "U+" AND "U−" lights should now be on.
16. Rotate the handwheel clockwise.
17. As the outside diameter of the wheel is approached, change the "SPEED/MULTIPLY" switch to a finer selection and eventually ending up with the "LOW" selected as the outside diameter of the wheel is just touched by the diamond roll.
18. While still in hand and the "U" axis lights on, depress the "DEFINE WHEEL" pushbutton, the "U" axis lights should now be off.
19. The "DEFINE WHEEL" fight should now be on indicating the diamond roll has been properly defined relative to the grinding wheel.
20. Depress the "RETURN" pushbutton.
21. The dresser should now return to the start of dress position. The "RETURN" light should now be on.
22. The dresser is now ready for an automatic "DRESS" or a "SIDEWALL DRESS" (only if the change wheel pushbutton had been selected).

The following requires the operator to be at the color CRT. Manual setup.

1. Select the "MANUAL SETUP" on the CRT.
2. The following are three choices to be considered:
   a. DRY RUN: ON/OFF Cycle dresser with diamond roll off and dresser coolant off.
   b. DRESS PASSES: SINGLE/CONTINUOUS Cycles the dresser the number of times selected in the continuous pass parameter.
   d. DRESSER LOCK FOR DRESSER RETURN: ON/OFF This selection, when on, locks the diamond roll on the return dress during a normal dress cycle.

In one operation, the roll R is rotated at a speed of about 1000 to 3500 rpm and advanced to the inner limit but spaced from the wheel side. The roll R is then moved to contact the wheel G and retracted, so dressing the wheel side surface until it reaches the periphery. The roll R is then moved off the wheel G and while spaced from it the roll is returned to the onboard limit position (see FIG. 1A). The roll R is then brought again along the side surface so that dressing is done in one direction only, which has the advantage of reducing surface glaze or burn and like surface defects. The method is repeated until both side portions have been dressed and the wheel G is, in the grinding region, of the predetermined width. The roll is then moved to dress the edge of the wheel, specifically to remove the corners to form the radii R1,R2. The roll is rotated at a speed of about 2400 rpm, i.e. faster than was used to dress the side portions.

Advantage of the invention are that:

i) the dressing is done much more quickly (minutes instead of hours)

ii) the dressing is done to a high standard of accuracy, iii) dressing is done with little or not risk of burn or glaze or other damage; and iv) dressing can be done with less skilled operatives.

What is claimed is:

1. A method of dressing a grinding wheel by advancing a dressing tool across the surfaces to be dressed, the method comprising first moving the dressing tool across each side portion of the grinding wheel to remove material to make the wheel of predetermined width and then across the edge of the wheel to form corner radii, including the step of moving the dressing tool in a closed loop, rotating the tool as it is moved and moving the tool at a speed of advancement across the side surfaces greater than that across the edge portion.

2. A method according to claim 1, wherein the dressing tool is caused to travel in successive paths across each side portion, each path starting remote from the circumference of the wheel and finishing adjacent that circumference.

3. A method according to claim 2, including the step of moving the tool away from the wheel once it is reached the circumference and then back to the start position for the next path, whereby the tool dresses the wheel in one direction only.

4. A method according to claim 1, including the step of supplying coolant liquid to the dressing tool to pass between the tool and the surface to be dressed.

5. A method according to claim 4, including mounting, the dressing tool in a holder supporting a power source for rotation of the tool and the coolant liquid is sprayed in a direction so as to cool also the power source.

6. A method according to claim 1, wherein the dressing tool is rotated at a speed of about 1800 rpm when dressing the side surface and about 2200 rpm when dressing the side surface.

7. A method according to claim 1, wherein the dressing tool has particles of diamond for the dressing action which particles have a mean particle size about 16 to about 28 mesh selected to avoid burn.

8. A method according to claim 7, wherein the particle size is about 18 to 20 mesh.

9. A method according to claim 7, wherein the particles are present in a density of about 1.8 to about 3 carats/sq.in.

10. A method according to claim 1, wherein the rotary tool has a diameter of about 7 cm (2.75 inch).

11. A method according to claim 1, including the step of controlling the rate of rotation and the speed of travel of the dressing tool by microprocessor control means.

12. A method according to claim 1, including the step of shaping the edge portion in addition to forming the radii.

13. A method according to claim 12, including the step of introducing curvature to the edge portion.

14. A rotary tool assembly for dressing a grinding wheel rotatable about an axis of the wheel, the rotary tool assembly comprising a rotary head assembly holding at its upper end a servomotor from which depends a spindle, a rotary dressing tool mounted at the free end of the spindle, the tool having natural particles for the dressing action which particles have a mean particle size selection to avoid burn, the spindle arranged to rotate the tool about the axis of the spindle, the axis of the spindle having a substantially perpendicular relationship to the axis of the grinding wheel.

15. A tool according to claim 14, wherein the particles are diamonds present in a density of about 1.8 to about 3 carats/sq.in.

16. A tool according to claim 14, wherein the particles are diamonds present in a density of about 2.9 to about 3 carats/sq.in.

17. A tool according to claim 14, wherein the rotary tool has a diameter of about 100 mm (3.937 inch).

* * * * *